US010124395B2

(12) United States Patent
Ertong et al.

(10) Patent No.: US 10,124,395 B2
(45) Date of Patent: Nov. 13, 2018

(54) FORGING DIES WITH INTERNAL HEATING SYSTEM

(71) Applicants: Lutfi Ertong, Ankara (TR); Mustafa Ilhan Gokler, Ankara (TR); Haluk Darendeliler, Ankara (TR); Cavat Komurcu, Ankara (TR)

(72) Inventors: Lutfi Ertong, Ankara (TR); Mustafa Ilhan Gokler, Ankara (TR); Haluk Darendeliler, Ankara (TR); Cavat Komurcu, Ankara (TR)

( * ) Notice: Subject to any disclaimer, the term of this patent is extended or adjusted under 35 U.S.C. 154(b) by 13 days.

(21) Appl. No.: 15/308,362

(22) PCT Filed: May 2, 2014

(86) PCT No.: PCT/TR2014/000184

§ 371 (c)(1),
(2) Date: Nov. 2, 2016

(87) PCT Pub. No.: WO2015/167407

PCT Pub. Date: Nov. 5, 2015

(65) Prior Publication Data

US 2017/0066039 A1 Mar. 9, 2017

(51) Int. Cl.

| | |
|---|---|
| ***B21J 1/06*** | (2006.01) |
| ***B21K 29/00*** | (2006.01) |
| ***B21J 13/02*** | (2006.01) |

(52) U.S. Cl.

CPC ..... *B21J 1/06* (2013.01); *B21J 13/02* (2013.01); *B21K 29/00* (2013.01)

(58) Field of Classification Search

CPC ..... B21J 1/06; B21J 9/08; B21J 13/02; B21K 29/00; B21D 37/16

See application file for complete search history.

(56) References Cited

U.S. PATENT DOCUMENTS

| | | | |
|---|---|---|---|
| 2,814,101 | A | 11/1957 | Prough et al. |
| 3,783,669 | A | 1/1974 | Furney, Jr. |
| 3,893,318 | A | 7/1975 | King, Jr. et al. |
| 4,088,000 | A | 5/1978 | Tomioka et al. |
| 4,889,570 | A | 12/1989 | Leong |
| 6,960,746 | B2 | 11/2005 | Chen |
| 2010/0307216 | A1 | 12/2010 | De Souza et al. |
| 2011/0259074 | A1 | 10/2011 | Ito et al. |

FOREIGN PATENT DOCUMENTS

| | | | |
|---|---|---|---|
| CN | 101077507 | B | 3/2011 |
| JP | S51157554 | U | 12/1976 |
| JP | H1157972 | A | 3/1999 |

*Primary Examiner* — Debra Sullivan
(74) *Attorney, Agent, or Firm* — Gokalp Bayramoglu

(57) ABSTRACT

The invention relates to a die heating system that is developed for preheating and continuous heating of forging dies (12) internally. The dies (12) are provided with channels (13) in which electrical heating cartridges (15) are placed with built-in thermocouples (16) monitored by a PID thermostat. The channels are located optimally in a zone (C) close to the die cavity for efficient heating but outside the zones of high forging load (D) or of rework requirement (B) or of high forging load after rework (A).

4 Claims, 6 Drawing Sheets

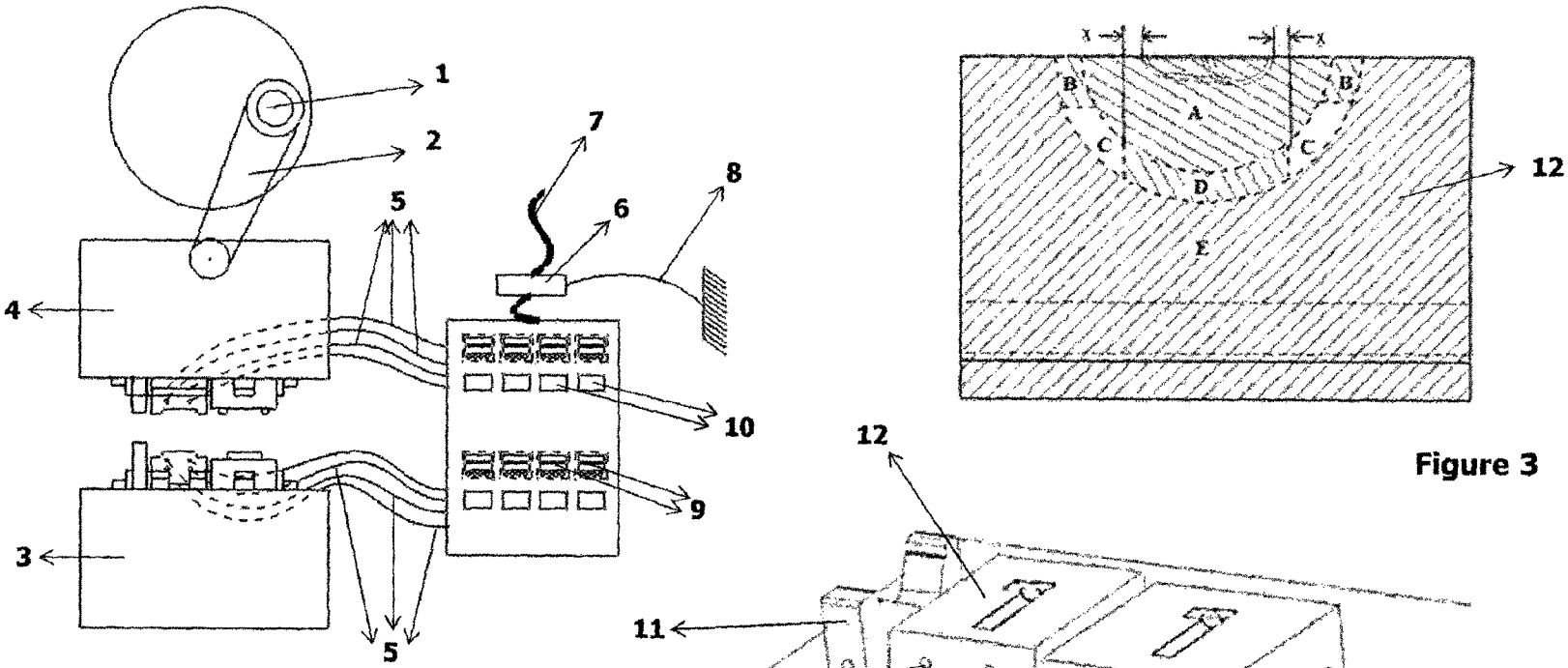
Figure 1
Figure 3
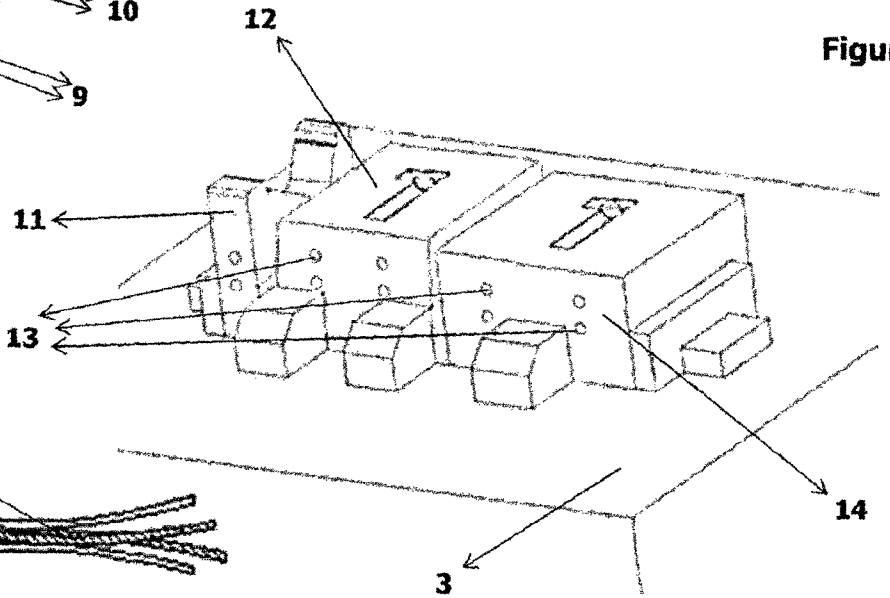
Figure 2
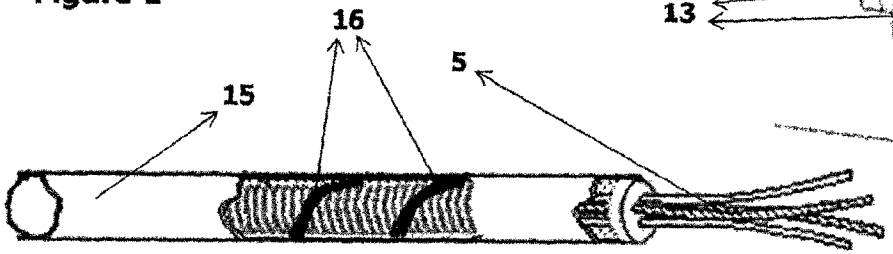
Figure 4

FORGING DIES WITH INTERNAL HEATING SYSTEM

CROSS REFERENCE TO RELATED APPLICATIONS

This application is a national phase entry application of International Application NO. PCT/TR2014/000184, file on May 2, 2014, the entire contents of which are incorporated herein by reference.

TECHNICAL FIELD

The invention relates to a die heating system that is developed for preheating and continuous heating of forging dies internally.

BACKGROUND

There are different classifications for forging. According to the classification based on temperature, forging is classified as cold forging, semi hot/warm forging and hot forging. Forging die type classification includes open die forging and closed die forging.

In hot forging and warm/semi-hot forging, the workpiece material is heated. Therefore forging dies before the forging process must be heated to avoid thermal shocks.

Although the workpiece material is initially at the room temperature in cold forging, heat is generated during the forging process due to the deformation of the workpiece. Therefore, cold forging dies may also be required to be heated before the forging process to avoid thermal shocks.

Improper heating of forging dies results in a variety of problems. The most significant one is the short die life, which is observed as a result of early failure or distortion due to thermal fatigue and non-uniform temperature distribution throughout the surface of the forging die.

Die Heating in Forging Process

The direct gas flame heating and the furnace heating are external die heating methods used in forging process. The first one is the most commonly used method in industry.

During the direct gas flame heating of the forging die, the forging equipment is generally kept idle. The problems encountered during the gas flame torch heating are mainly long heating time and uncontrollable temperature distribution. To keep the forging dies at the required temperature during production of a batch of forging, the forging dies are reheated frequently by means of the gas flame torches by stopping the process from time to time. This type of heating requires considerable shop floor time. The use of gas flame heating method is a very inefficient and unsatisfactory method of heating because only a small portion of the generated heat of the combustion gasses is transferred to the forging die while most of the heat escapes to air.

In furnace heating, the forging dies are placed in to the furnace before the heated dies are located on the forging press. Although, uniform temperature may be obtained throughout the forging die. One of the main disadvantages of the furnace heating in forging industry is that the forging dies need to be assembled and disassembled each time when heating is required. The other disadvantage is the limitation of the furnace size. These facts cause an increased process time and cost.

In US 2011/02509074 A1, a die holder with electrical resistance cartridge heaters is used to heat the dies in forging process. The die holder is used to hold the die in forging press. The die holder has also temperature sensors for monitoring temperature distribution on the die. To reduce the press forces applied to resistance heaters and temperature sensors on the die holder, the resistance heaters are located in the middle of the die holders. This can reduce the foregoing press load placed on the heaters but the distance from the dies is high and the heat generated from the heaters is poorly transmitted to the dies and the heating time increases. As a result, a problem arises that the heaters cannot efficiently heat the dies to the required temperature ranges for preheating and keeping the die hot.

In U.S. Pat. No. 3,783,669, the structure under the base of the forging die provides gas heating. The structure is made up of multiple bars of high strength materials located between the dies and the anvil of the forging press. The bearing bars take the forging loads. Insulation and burners that are located in bearing bars receive no forging loads. This method is an inefficient method to heat the dies and the combustion gasses pollutes environment.

US 2010/0307216 A1, U.S. Pat. No. 3,893,318, U.S. Pat. No. 4,889,570, U.S. Pat. No. 6,960,746 and U.S. Pat. No. 4,088,000 can also be recognized as prior art techniques for die heating, which none of them concerns of internal heating of dies.

Possible Applicability in Forging Industry of the Die Heating Methods Used for Other Manufacturing Processes There are some methods used in industry to heat the dies of the manufacturing processes other than forging. The electrical and gas radiant heating use radiation as the heat transfer mean. Heating temperature is available instantly. Radiation to atmosphere is the main loss of the energy. The internal regions of the large dies need long preheating time to reach desired temperature. If the heater is placed too close to the die, this negatively affects condition of the heater itself by increasing temperature of the heater. This may cause damage of the heater due to excessive heating. Gas radiant heating method also creates pollution problem.

The electrically heated air or gas plasma torch provides air heated to 750° C.-1300° C. without air or noise pollution. The use of such system reduces the power required to heat the dies compared to the furnace heating and better temperature distribution compared to gas flame heating. During heating by air, a heat insulation blanket is applied to get better heating performance and reduce heat losses. During forging process, it is not possible to use air heating method with insulation blankets.

The technical disadvantages and problems of the prior art techniques for forging die heating can be lined up as;

- Operational difficulty.
- Long heating time,
- Operational time losses,
- Energy losses,
- Causing environmental pollution due to combustion gasses.
- Decarburization on forging die surface due to gas flames.
- Non-uniform temperature distribution on forging dies,
- High die surface wear that results in increasing the number of rework of the forging dies,
- Undesired rapid cooling of forging dies,
- Poor part quality due to forging die wear,
- Reduce batch size,
- Risk of broken or damaged forging dies,
- Thermal fatigue on forging die surfaces,

SUMMARY OF THE INVENTION

Although different internal heating systems have already been in use in plastic injection industry, die casting industry and sheet metal forming industry as the forging operation is conducted under high pressure, there is no internal heating system application used in forging as explained in the present invention.

The present invention discloses an internal heating system for forging dies by using electrical cartridge heaters placed inside the channels drilled at feasible locations relative to the die cavity. The system is automated to preheat the forging die and control the temperature of the die during the forging process. The system is used for hot, warm or cold forging of steel, aluminum, copper, titanium alloys or any other metal forged in forging industry.

The aims of this internal heating system for forging dies are:

- To eliminate/reduce thermal fatigue.
- To obtain operational ease and convenience,
- To eliminate operational time losses through short pre-heating time,
- To apply heating energy directly to the forging dies,
- To create a heating system that generates no combustion gasses and pollution,
- To eliminate decarburization on forging die surfaces,
- To increase the uniformity of the temperature distribution on the forging dies,
- To reduce the forging die surface wear in order to increase the number of parts to be forged before rework of the forging dies, therefore increasing the die life.
- To increase the uniformity of high impact toughness on the forging die,
- To prevent forging die cooling during the forging process,
- To slow down the decreasing of hardness
- To keep forging dies structurally intact,
- To save the operation time by preheating the forging dies before installation of the forging die on the press if required.
- The proposed method can also be applied for cold forging as well as hot forging and warm/semi-hot forging.

BRIEF DESCRIPTION OF THE DRAWINGS

In order to explain the present invention in more detail, the following figures have been prepared and attached to the description. The list and the definition of the figures are given below.

FIG. 1 is the general view of the heating system

FIG. 2 is the perspective view of the forging dies mounted on the top of the anvil FIG. 3 is the sectional view of the forging die without channels FIG. 4 is the inside view of an Electrical heating cartridge

DEFINITION OF THE ELEMENTS (FEATURES/COMPONENTS/PARTS) ON THE FIGURES

Figure 7:
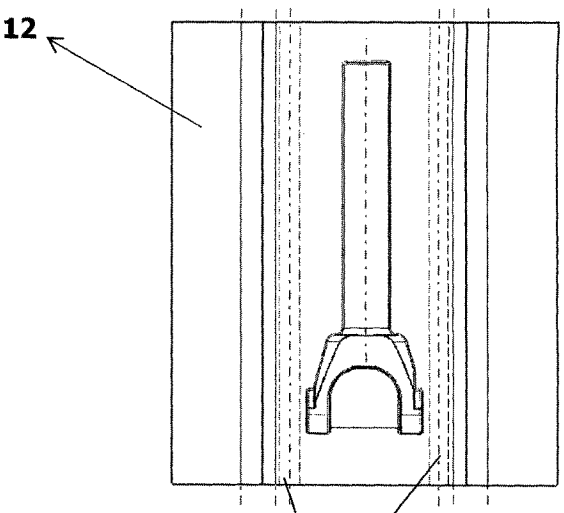
FIG. 7 is the top view of a "rod end" forging die equipped with channels

The definition of the features/components/parts that are covered in the figures that are prepared in order to explain the present invention better are separately numbered and given below.

1. Press crank (prior art)
2. Connecting Rod (prior art)
3. Press table (Anvil) (prior art)
4. Press RAM (prior art)
5. Electrical heating cartridge power cables
6. System fuses (prior art)
7. Electrical power line
8. Electrical grounding
9. Thermal controllers
10. Electrical contactors
11. Forging die for the first preforming stage
12. Forging die for the final stage
13. Channels for electrical heating cartridges
14. Forging die for the second preforming stage
15. Electrical heating cartridge
16. Electrical heating cartridge thermocouple

DETAILED DESCRIPTION

In the present invention, novel forging dies with the internal heating system are used on a prior art forging equipment. For example in FIG. 1 an existing forging press is shown comprising of press crank (1) that drives press RAM (4) by connecting rod (2) towards press table (3) which incorporates the present invention's;

forging die for the first preforming stage (11),
forging die for the second preforming stage (14), and
forging die for final stage (12),
all having channels (13) drilled to fit electrical heating cartridges (15).

Typical die sets are shown in FIG. 2.

The present invention is applicable to any forging die used in hot forging, warm/semi-hot forging and cold forging processes.

The internal heating system for forging dies explained in the present invention comprises;

- independent auto-tune PID (Proportional Integral Derivative) thermostats as thermal controllers (9) to monitor the surface temperatures of forging dies (11, 12 and 14) via built in thermocouples (16) of electrical heating cartridges (15) and to control electrical contactors (10),
- electrical contactors (10) to switch on/off electrical heating cartridges (15) in response to thermal controller signals (9), electrical heating cartridges (15) placed in channels (13) for pre-heating and continuous heating of forging dies (11, 12 and 14), channels (13) drilled on forging dies (11, 12 and 14) to place electrical heating cartridges (15), a method for the determination of the proper locations of channels (13) and placement of channels (13) inside forging dies (11, 12 and 14), and a method of preheating and continuous heating of forging dies (11, 12 and 14) internally.

The length of channels (13) drilled on forging dies (11, 12 and 14) is equal to the length of forging dies (11, 12 and 14).

Channels (13) extend between the corresponding free surfaces of forging dies (11, 12 and 14) and have openings on both surfaces.

The method for the determination of the proper locations of channels (13) and placement of channels (13) inside forging dies (11, 12 and 14) is explained below.

FIG. 3 illustrates the determination of the feasible zones for locating electrical heating cartridges (15) inside channels (13) of forging dies (11, 12 and 14).

Zone "E" is too far from the die cavity to be an efficient heating location. Thus, it is classified as a poor heating location for cartridge (15).

Due to high forging loads, zone "A" at the neighborhood of the die cavity may have high stresses and will not be suitable for locating cartridges (15).

Due to the rework allowance requirement, "B" zones are not suitable either.

After rework, the zone "D" will be in the high stress zone, therefore zone "D" should also be avoided.

Therefore, "C" zones are the only feasible locations to drill channels (13) for placing electrical heating cartridges (15).

In addition, a horizontal clearance "x" is required between channels (13) and the die cavity profile, "x" value is at least the half of channel's (13) diameter. As the diameter of channel (13) changes in relation to the size of forging die (11, 12 and 14), "x" value also changes in relation to the size of forging die (11, 12 and 14).

With regard to the above explanation, the method for the determination of the proper locations of channels (13) in forging dies (11, 12 and 14) comprises of the following steps:

Determining the A, B, C, D and E zones below the cavity of the forging die in regard to the;
distance from the die cavity
amount of the forging loads,
rework allowance requirement, and
potential of being a stress zone after rework, Determining the horizontal clearance value "x" "between channels (13) and the die cavity profile.

In FIG. 4, a typical cartridge heater is shown.

Figure 6:
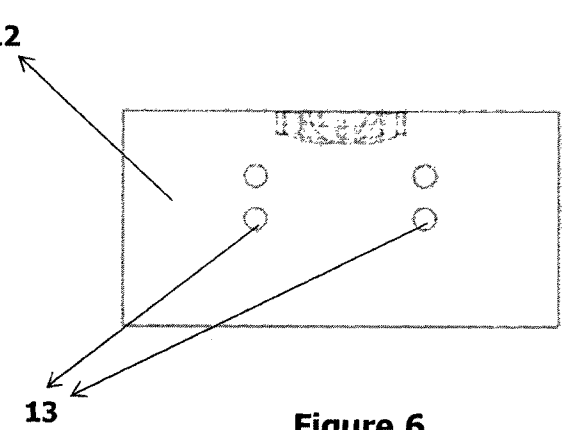
FIG. 6 is the sectional view of a "rod end" forging die equipped with channels
Figure 5:
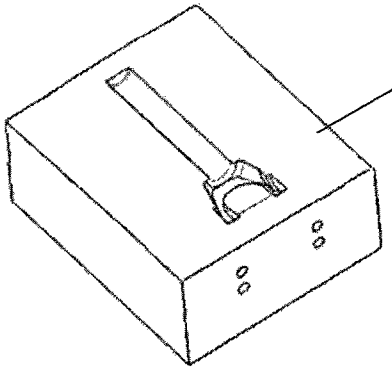
FIG. 5 is the perspective view of a "rod end" forging die equipped with channels

In FIGS. 5-7, perspective, sectional and top views of the rod end are given.

Figure 10:
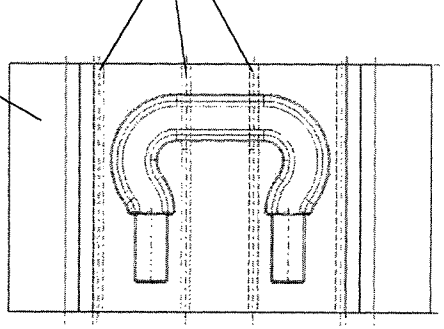
FIG. 10 is the top view of a "U handle" forging die equipped with channels
Figure 9:
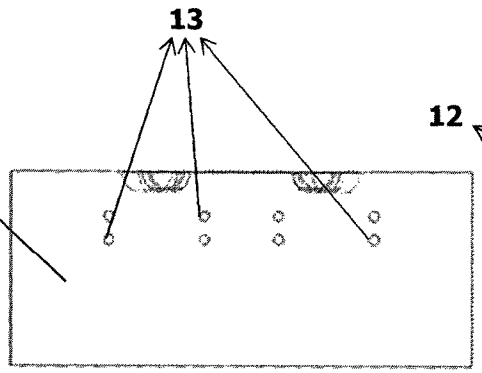
FIG. 9 is the sectional view of a "U handle" forging die equipped with channels
Figure 8:
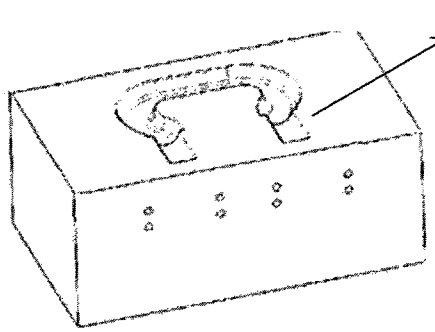
FIG. 8 is the perspective view of a "U handle" forging die equipped with channels

In FIGS. 8-10, perspective, sectional and top views of a U handle die are shown.

Figure 11:
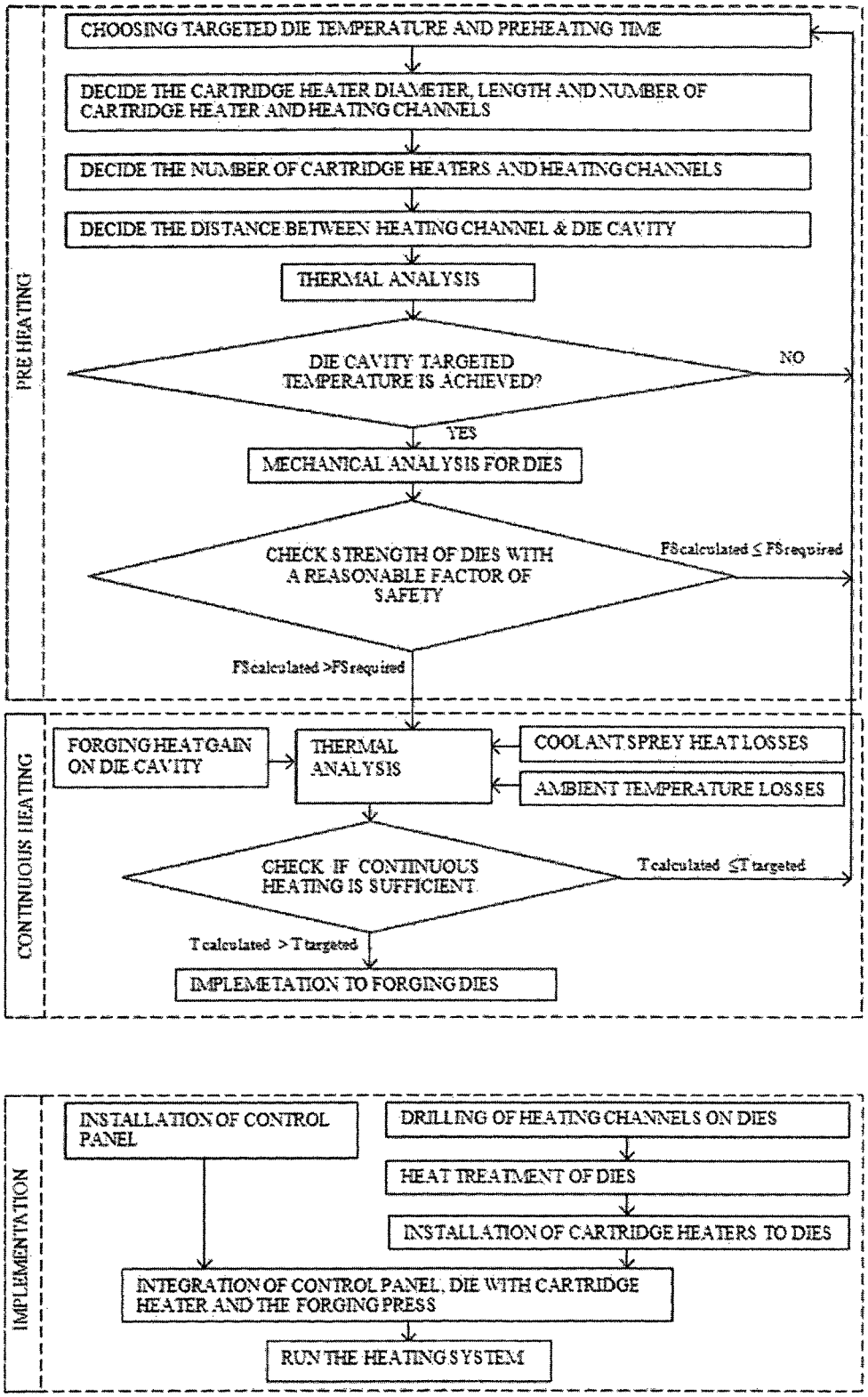
FIG. 11 is the flow chart of pre-heating, continuous heating and implementation of the internal heating system

A detailed flow chart with regard to the pre-heating, continuous heating and implementation of the internal heating system is shown in FIG. 11.

In the flow chart as shown in FIG. 11, research and development stage for the present invention is explained. As the first stage, the targeted die temperature and the preheating duration are decided. To design a system for the preheating of forging dies (11, 12 and 14), initial guess for the number, the diameter and the length of electrical heating cartridges (15) are considered to perform the thermal analysis. Channel (13) orientation is considered to get the uniform temperature distribution on the die cavity surface. Horizontal orientation of channels (13) must be applied due to the assembly possibilities in the heating system installation. Commercially available cartridge heater catalogues are used to select cartridge (15) diameter and the length that affect the heating power and heating time. By considering the capacity of single cartridge (15) chosen from the catalogue, the number of cartridges (15) to be used and therefore the number of channels (13) to be drilled in the die are determined.

Transient thermal analysis on computer environment has been conducted. According to the thermal analysis results, if the system is not sufficient to reach the required temperatures on the die surfaces within the targeted time, the number of cartridges (15) or the location or the diameter of cartridges (15) is changed and the thermal analysis is repeated.

Figure 15:
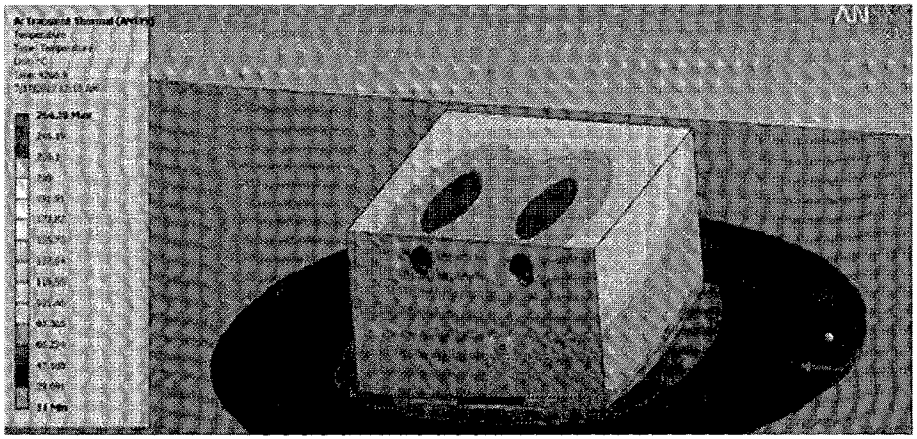
FIG. 15 is the perspective view of the transient thermal analysis results of the forging die during pre-heating
Figure 16:
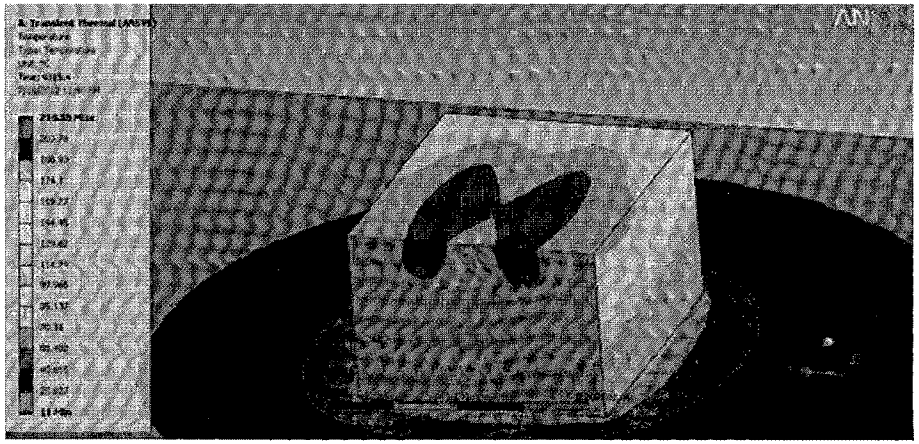
FIG. 16 is the perspective view of transient thermal analysis results of the forging die during continuous heating

Typical transient thermal analyses are shown in FIG. 15 and FIG. 16.

A specifically tuned computer software has been used for transient thermal analysis. During the analysis it was seen that the heater locations and the number of the heaters directly effect the heating time.

In thermal analysis, convection, conduction and radiation during the forging process have been considered as the inputs for thermal analysis.

During forging simulations, it is seen that the temperature increase in the forging process is negligible. In forging simulation, the heat transfer from workpiece to forging die occur mainly during the stay of the workpiece on die after the forging process. This duration is about ten times longer than forging duration. The workpiece cools on the die and the die gets higher temperatures on cavity surfaces. To compensate this affect, a coolant is applied on the die cavity region that has contact with the hot workpiece. These facts are also inputs to the transient thermal analysis for continuous heating stage.

Stress analysis is also performed before the implementation of the die heating system. Forging load creates stress throughout the die, channels (13) of cartridges (15) may create stress concentrations, and this may cause die failure. Therefore, certain distance is required between channels (13) of and the die cavity surface. The stress check of the dies is performed to see the factor of safety. If the factor of safety is not sufficient then the number or the location or the diameter of cartridges (15) are changed and the thermal analysis and the stress analysis stages are repeated.

A specifically tuned computer software has been used for stress analysis. During the stress analysis the mechanical press crank radius, R, rod length, L, and revolution, REV is used as the input to the simulation.

Figure 18:
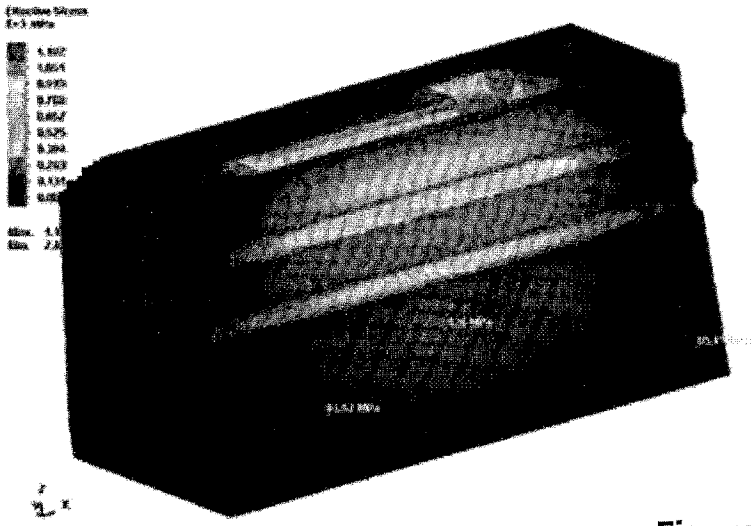
FIG. 18 is the perspective view of stress analysis results of the forging die with internal heating system
Figure 17:
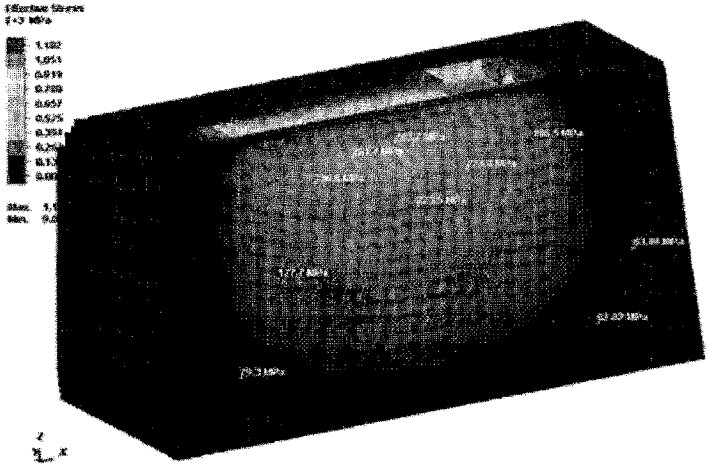
FIG. 17 is the perspective view of the stress analysis results of the forging die without internal heating system

Die and workpiece friction coefficient, plastic shear friction, interface friction factor is used as the inputs to the simulation software. Die material mechanical properties for different temperature values are also used as the input to the software. Stress concentrations occur near the heater holes and the sample thermocouple holes. Stress distribution of the dies without heating channels is shown in FIGS. 17 and 18.

Steps for the continuous die heating are also given on the flowchart shown in FIG. 11. Thermal analysis of the system design is repeated with the thermal data obtained in preheating analysis stage. Thermal analysis is performed considering the heat gain to the die due to hot forging billet and losses due to coolant sprays and convection losses to environment. If the system is sufficient to perform continuous heating then the system is implemented to forging process.

If additional heat power is needed to provide continuous heating then the design parameters are changed and the preheating and continuous heating analyses are repeated.

In FIG. 11, the flow chart of the implementation of the internal die heating system is given. The control panel of the system together with electrical components is purchased to meet the requirements of the heating system. Power (5) and thermocouple cables (16) are connected with a steel spiral cables for the insulation and protection. The next stage is the installation of the die heating system to forging press (3 and 4). The control unit should be away from forging press (3 and 4) and ground connection of press (3 and 4) and cartridges (15) should be completed for the safety of the operation. Spiral cables are clamped to connecting rod (2) on the press.

In drilling operation, channels (13) should have certain tolerance and clearance value to install cartridges (15). For ease of assembly/disassembly, channels (13) are drilled longitudinally. After drilling forging dies (11, 12 and 14), dies are heat-treated and the dimensional changes due to heat treatment should be concerned in drilling of the die.

In the application, after forging dies (11, 12 and 14) are assembled to press (3 and 4), the heating system is also assembled to forging dies (11, 12 and 14) and press (3 and 4). Then the heating system is started before the forging operation starts. When forging dies (11, 12 and 14) reaches to the required temperature then the forging operation may start and the temperature of the die should be measured and monitored via the display on the control panel. During forging operation, die surface temperature is continuously monitored to observe whether the measured temperature is within the upper and lower limits.

The method for preheating and continuous heating of forging dies (11, 12 and 14) of the present invention is explained below.

In preheating stage, the heating system is started before the forging operation in order to pre-heat forging dies (11, 12 and 14) to the required temperature. When forging dies (11, 12 and 14) reached to the required temperature then the forging operation starts.

In continuous heating, during the forging operation, forging die (11, 12 and 14) surface temperature is continuously monitored via built in thermocouples (16) of electrical heating cartridges (15) and the temperature is controlled and kept within the upper and lower limits.

Figure 12:
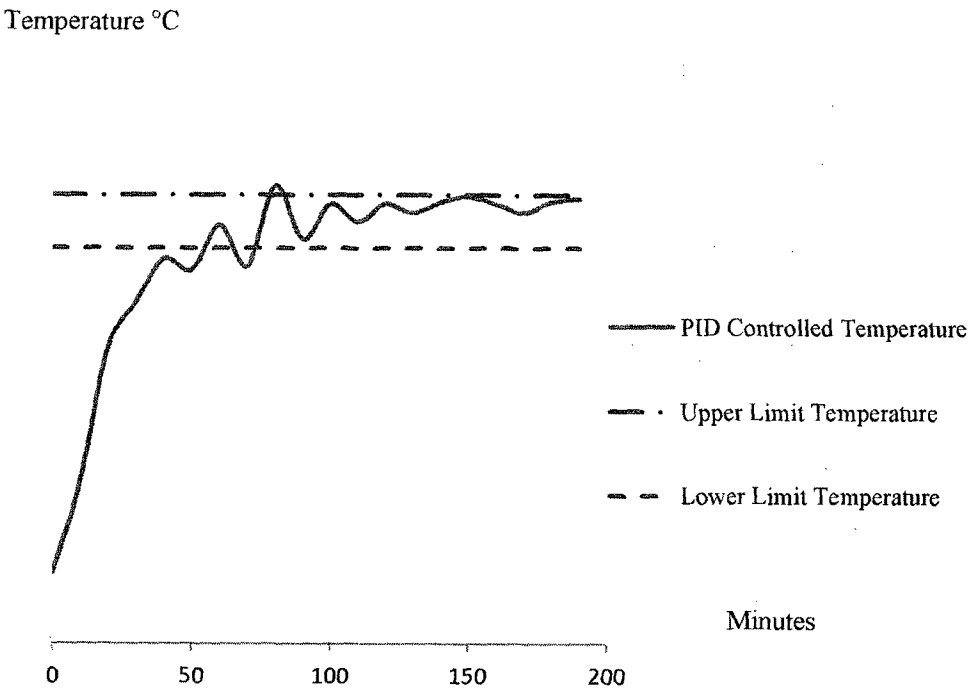
FIG. 12 is the PID (Proportional Integral Derivative) control strategy chart of the internal heating system

PID (Proportional Integral Derivative) control strategy of the internal heating system is shown in the chart on FIG. 12. PID control switches on electrical heating cartridges (13) to reach to the targeted temperature when temperature is below the lower limit temperature. When the temperature is above the targeted temperature/upper Limit Temperature. PID control switches off electrical heating cartridges (13) to decrease the temperature when the temperature is above the upper limit temperature. The temperature is tried to be settled within the upper and lower limit temperatures and this controlled temperature becomes closer and closer to the target temperature in time.

Comparison of the Present Invention and Gas Flame Heating with Regard to the Forging Die Wear Rates The present invention has been tested in industrial applications, as shown in FIG. 1.

Figure 13:
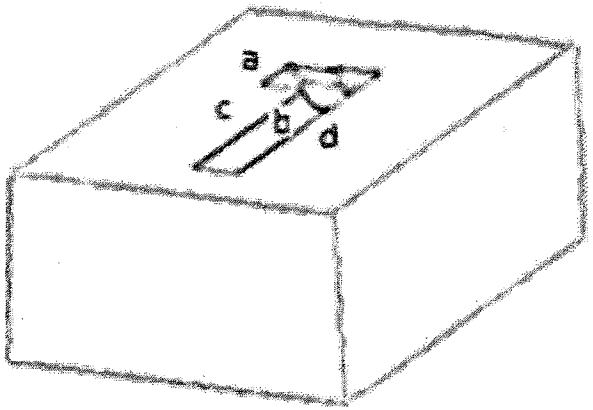
FIG. 13 is the perspective view of the forging die showing the measurement locations of die wear

In Table 1, forging die wear measurements on forging dies (11, 12 and 14) of press table (3) with gas flame heating and forging dies (11, 12 and 14) with internal heating system are shown. Forging die wear measurements points are also shown in FIG. 13. Although the forged part number is doubled in a forging process with internal heating system compared to a forging process with gas flame heating, the wear measurement on forging dies (11, 12 and 14) with internal Heating system is lower than that on forging dies (11, 12 and 14) with gas flame heating.

TABLE 1

Comparison of the present invention and gas flame heating with regard to the forging die wear rates

| | 1-Forging dies with Gas flame Heating (2500 Parts) | 2-Forging dies with Internal Heating system (5000 Parts) |
|---|---|---|
| a | 0.50 mm | 0.10 mm |
| b | 0.06 mm | 0.03 mm |
| c | 0.20 mm | 0.05 min |
| d | 0.25 mm | 0.10 mm |

Figure 14:
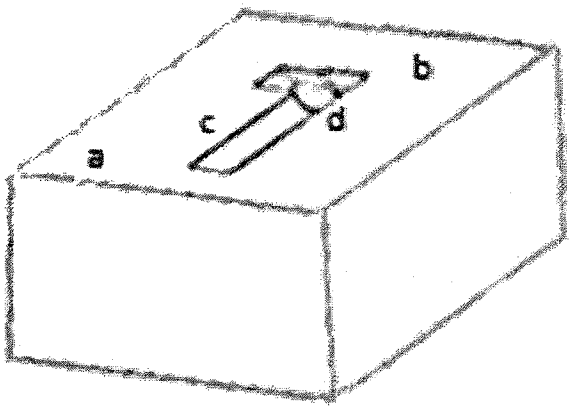
FIG. 14 is the perspective view of the forging die showing the measurement locations of die hardness

Comparison of the Present Invention and Gas Flame Heating with Regard to the Forging Die Hardness In the tests, the forging die hardness before heating forging dies (11, 12 and 14) is 43-44 HRC. The measurement points are shown in FIG. 14. After forging of 5000 parts and the hardness drops down to 40-41 HRC for forging dies (11, 12 and 14) of press table (3) and 41-42 HRC for forging dies (11, 12 and 14) of press ram (4).

As shown in Table 2, longer die life has been observed with internal heating system compared to gas flame heated forging dies.

TABLE 2

Comparison of the present invention and gas flame heating with regard to the forging die hardness

| | 1-Forging dies with Gas flame Heating (2500 Parts) | 2-Forging dies with Internal Heating system (5000 Parts) |
|---|---|---|
| Initial Hardness | 43.0-44.0 HRC | |
| a | 39.3 HRC | 40.0 HRC |
| b | 39.6 HRC | 41.0 HRC |
| c | 39.4 HRC | 40.6 HRC |
| d | 39.4 HRC | 40.4 HRC |

The invention claimed is:

1. A forging die comprising:

at least one channel drilled on the forging die to place at least one electrical heating cartridge therein, wherein the channel extends between corresponding free surfaces of the forging die and have openings on the corresponding free surfaces of the forging die, the at least one electrical heating cartridges placed in the channel for pre-heating and continuous heating of the forging die, an independent auto-tune PID (Proportional Integral Derivative) thermostat as thermal controller configured to monitor surface temperatures of the forging die via at least one built in thermocouple cable of the electrical heating cartridge and to control a plurality of electrical contactors, wherein the thermocouple cable in a spiral form extends over the length of the electrical heating cartridge; and the plurality of electrical contactors to switch on/off the electrical heating cartridge in response to thermal controller signals.

2. The forging die according to claim 1, wherein a horizontal clearance between the channel and a die cavity profile is at least half of a diameter of the channel.

3. The forging die according to claim 1, wherein the proper location of the plurality of channels and placement of the channel inside the plurality of forging dies is determined by performing a thermal analysis, wherein the thermal analysis comprises determining a diameter and a length of the electrical heating cartridges before the thermal analysis, determining a number of the at least one electrical heating cartridges to be used by considering a capacity of a single electrical heating cartridge, conducting a transient thermal analysis on a computer, changing the number or a location or the diameter of the electrical heating cartridges and repeating the transient thermal analysis, to determine a point when the surface temperatures of the forging die reach within a targeted temperature according to the thermal analysis results, performing a stress check of the forging die to determine a factor of safety, changing the number or the location or the diameter of the electrical heat cartridges and repeating the transient thermal analysis and the stress analysis if the factor of safety till a predetermined factor of safety is reached, performing a pre-heating and continuous heating analysis by considering a heat gain of the forging die due to hot forging billet and losses caused by coolant sprays and convection losses to environment, changing the number or the location or the diameter of the electrical heating cartridges and repeating the transient thermal analysis and the stress analysis, if an additional heat power is needed to provide continuous heating, and if no additional heat power is needed to provide continuous heating, determining the location of the electrical heating cartridges as the proper location of the plurality of channels.

4. A method for preheating and continuous heating of a plurality of forging dies, the plurality of forging dies comprising;

a plurality of channels drilled on the plurality of forging dies to place a plurality of electrical heating cartridges, wherein the plurality of channels extend between corresponding free surfaces of the plurality of forging dies and have openings on the corresponding free surfaces of the plurality of forging dies, the plurality of electrical heating cartridges placed in the plurality of channels for pre-heating and continuous heating of the plurality of forging dies, an independent auto-tune HD (Proportional Integral Derivative) thermostats as thermal controller to monitor surface temperatures of the plurality of forging dies via a plurality of built in thermocouple cables of the plurality of electrical heating cartridges and to control a plurality of electrical contactors, wherein the built in thermocouple cables in a spiral form extend over lengths of the electrical heating cartridges;

the plurality of electrical contactors to switch on/off the plurality of electrical heating cartridges in response to thermal controller signals and, wherein a location of the plurality of channels and placement of the channel inside the plurality of forging dies is determined, the method comprising the steps of;

starting the pre-heating before a forging operation, pre-heating the plurality of forging dies to a required temperature before the forging operation, continuously monitoring the surface temperature of the plurality of forging dies during the forging operation via the built in thermocouple cables of the electrical heating cartridges, controlling and keeping the surface temperature of the plurality of forging dies within a predetermined upper limit and a predetermined lower limit by switching on the plurality of electrical heating cartridges to reach to a targeted temperature when the surface temperature is below the predetermined lower limit, and switching off the plurality of electrical heating cartridges to decrease the surface temperature when the surface temperature is above the predetermined upper limit.

* * * * *